US006905428B1

(12) United States Patent
Lang

(10) Patent No.: US 6,905,428 B1
(45) Date of Patent: Jun. 14, 2005

(54) UNIVERSAL CROQUET WICKET LIGHTING UNIT

(76) Inventor: David Dell Lang, 2222 70th Ave. SE., Mercer Island, WA (US) 98040

( * ) Notice: Subject to any disclaimer, the term of this patent is extended or adjusted under 35 U.S.C. 154(b) by 41 days.

(21) Appl. No.: 10/721,687

(22) Filed: Nov. 25, 2003

(51) Int. Cl.[7] ..... A63B 63/00
(52) U.S. Cl. ..... 473/411; 473/410
(58) Field of Search ..... 473/410–413, 473/168–170; 273/398–402

(56) References Cited

U.S. PATENT DOCUMENTS

| | | | | |
|---|---|---|---|---|
| 161,080 | A * | 3/1875 | West | 473/411 |
| 280,807 | A | 7/1883 | Farley | |
| 5,265,875 | A * | 11/1993 | Fitzgerald | 473/169 |
| 5,370,390 | A | 12/1994 | Swanson | |
| 6,099,139 | A * | 8/2000 | Lapensee | 362/153.1 |
| 6,712,721 | B2 * | 3/2004 | Buzak et al. | 473/411 |
| 6,758,767 | B1 * | 7/2004 | Wang | 473/410 |

FOREIGN PATENT DOCUMENTS

| | | | | |
|---|---|---|---|---|
| JP | 10118231 | A * | 5/1998 | A63B 63/00 |

* cited by examiner

*Primary Examiner*—Mark S. Graham

(57) ABSTRACT

A croquet wicket lighting unit to provide illumination in the vicinity of a wicket to facilitate playing the game of croquet under conditions of low illumination. Components are attached to a mounting plate 11 that straddles the wicket. The mounting plate universally and firmly attaches to any size or style of wicket by means of retaining straps 24 and friction pads 25 in combination with universal engaging slots 12. The illumination element directs an intense beam of focused light through a hole 13 in the mounting plate and onto the playing surface immediately under the wicket to clearly reveal the passage of a ball through the wicket. The illumination scheme also casts a larger area of more diffuse light on the playing surface immediately adjacent to the focus spot to reveal croquet balls resting therein and facilitate play around the wicket.

1 Claim, 6 Drawing Sheets

UNIVERSAL CROQUET WICKET LIGHTING UNIT

CROSS-REFERENCE TO RELATED INVENTIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

This invention pertains to the game of croquet, a game played out of doors on a course usually laid out on grass lawns. The equipment needed to play croquet, called a "croquet set", consists of balls, striking mallets, wickets, and stakes. Wickets are in the general shape of an inverted "U", the two legs of which are called stanchions. The two stanchions are impaled in the ground forming an arch through which a ball may pass. Stakes delineate various points of play within the course. The balls, precisely driven with mallets, are aimed at and must pass through wickets, with the game's objective being to traverse the course using fewer mallet strikes than opponents. The game of croquet traditionally has been played under daylight conditions so that players could see the wickets for the purpose of aiming shots and observing the passage of balls through wickets. However, croquet is often played as a form of entertainment under social party conditions. Such play, termed "yard croquet", uses a home's yard area to layout conventional or irregular wicket courses conforming to available space. Yard croquet is frequently played under poor lighting conditions since social events typically extend into the evening. Diminishing daylight often curtails croquet play, since yard party lighting conditions are usually inadequate for seeing wicket positions or the passage of balls through wickets. This problem is exacerbated by wickets' being commonly fabricated from wire, making them difficult to see and determine if a ball has in fact passed through, or merely close beside, the wicket. Poorly illuminated wickets also present a tripping hazard for those walking on the course.

Casual attempts have been made to illuminate wickets. An example of this is the use of party lighting, such as strings of colored lights, to provide area lighting. This generally fails to clearly expose position or orientation of all the wire wickets as it is difficult to sufficiently illuminate an entire course in this fashion, especially if it meanders around corners of houses and garden areas, etc. Wide area lighting of sufficient brightness to clearly illuminate wire wickets at a distance is usually too bright to be aesthetically appealing for a night time social event. Another approach is to illuminate wickets by placing a candle in a paper sack near each wicket. This is unsatisfactory because the resulting diffuse illumination does not reveal a wicket so as to allow a distant player to see its exact center or orientation as needed to aim a ball through the wicket; furthermore, it does not clearly reveal the passage of a ball through a wicket. In addition, the candle and sack are subject to being struck by a ball, upsetting the sack, and possibly creating a fire hazard.

In order to facilitate and popularize night croquet to new levels, what would be desirable, but is missing, is a form of wicket lighting that:

1. illuminates wicket position and orientation from a distance,
2. clearly enables players to see a ball's passage through a wicket,
3. provides an aim point for players attempting a wicket shot from a distance,
4. is convenient to use and universally attaches to any style of preinstalled croquet wicket,
5. does not require the consumer to replace any existing croquet set components,
6. does not detract from darkness adaptation of the eye,
7. tolerates impact abuse from ball or mallet strikes,
8. is portable with self-contained power, requiring no external power source on the croquet course,
9. provides a low cost of operation,
10. consists of components that will not wear out quickly, providing a long useful life,
11. does not present hazards, and is tolerant of outdoor weather conditions, and
12. does not detract from social party ambiance, and ideally, even adds an element of festivity to the croquet course and party ambiance.

Prior art has been discovered that attempts to fulfill at least some of the needs listed above. All such attempts that I am aware of are discussed below.

In U.S. Pat. No. 280,807 to Farley (1883), claim is made to illuminate all of the individual components of a croquet set by means of an unspecified luminous type paint. This includes mallets, balls, and stakes, as well as the wickets. Such a technique has many drawbacks, all related to the use of luminous paint. Modern luminous paints are of three types; (a) those that must be energized by exposure to light prior to use, (b) those that derive illumination from the admixture of radioactive substances, and, (c) those that fluoresce under illumination by external ultraviolet light. All of these paints are unable to provide area illumination other than at the actual surface to which the paint is applied. A painted item provides light that can be seen at a distance, but not light strong enough to illuminate surrounding areas. This weakness is particularly troublesome in the case of wickets. Wickets are commonly made of wire, presenting very little luminous surface to provide secondary illumination onto surrounding areas. Thus, at best, luminous paint will only suffice to mark the location and orientation of a wicket, and will do little to illuminate the playing surface under or around the wicket to reveal the passage of a ball through a wicket. My invention provides this missing attribute. Listed below are other drawbacks specific to each of the three types of luminous paints as they might apply to U.S. Pat. No. 280,807; alternatively, I present the attribute of my invention that would resolve each drawback.

a. Luminous paints energized by pre-exposure suffer from low luminosity for this application. Furthermore the amount of illumination deteriorates rapidly with time, so that only limited use is possible before the paint must be re-energized by exposure to light. It is questionable whether the duration of useful illumination would be long enough for a typical game of croquet. My invention provides a steady bright source of illumination for any length of croquet session.

b. Luminous paints that derive their luminosity from admixture with a radioactive substance suffer from low luminosity for the application of illuminating croquet play, and also may pose toxic hazards. Such paints are expensive and would likely be prohibitive to use in the quantities required for a consumer croquet set. My invention is a non-hazardous device of reasonable cost.

c. Luminous paints deriving their luminosity from incident ultraviolet light require that all parts of a yard croquet course be illuminated by ultraviolet lighting. This requires conventional power on the course, as well as a set up of wide area ultraviolet lighting, all of which present inconveniences. My invention contains its own power source and can be conveniently attached to wickets where ever they may be located, thus requiring no special logistic support for their use.

It is likely because of these drawbacks that products based on the claims of U.S. Pat. No. 280,807 are not being marketed.

In U.S. Pat. No. 5,370,390 to Swanson (1994), the claims indicate construction of an entire new croquet set, rather than utilizing existing equipment; this includes new mallets, balls, and stakes, as well as new wickets. Chemical light sticks are integrated into each item of the croquet set so as to allow replacement of depleted light sticks with freshly activated light sticks as needed. Such a technique has many drawbacks related to the use of light sticks as well as other factors; each drawback is listed below along with the respective superior attribute that my invention would provide:

a. In proposing to solve the problem of playing croquet under low illumination conditions, this prior art claims an entirely new croquet set design replacing conventional croquet set elements. This forces users to replace existing croquet sets to enjoy night croquet. My invention does not require any replacement of a consumer's existing croquet equipment. The lighting device claimed in my invention is additive to existing croquets sets, and is neither a mallet, a ball, a stake nor a wicket. Consumers adopting my lighting solution are saved the expense of duplicating existing croquet components.

b. The production of a completely new croquet set design, indicated in this prior art, requires a manufacturing facility to fabricate the many and varied elements of this new croquet set design. On the other hand, the device of my invention is simple to fabricate, requiring manufacture of a single item that is attached to the consumers' existing croquet wickets.

c. Light sticks produce diffuse light, rather than a concentrated intense beam of light. A focused beam is needed on the area directly under the wicket to unambiguously reveal the passage of a ball through the wicket. The device of my patent claim provides this essential feature to the play of croquet.

d. Activation of a light stick initiates a chemical process that cannot be stopped, and it steadily subsides with time over a number of hours until it ceases to provide useful illumination. A light stick will provide only one evening of play before needing replacement. Comparing the cost of light sticks to batteries reveals that to illuminate wickets for an evening of croquet would cost at least 40 times more using light sticks than using my battery operated invention. Thus my invention provides a far lower operating cost than the light stick approach.

e. There are two forms of abuse suffered by croquet wickets, (a) the force or impact required to install a wicket into the playing surface, and, (b) ill-directed mallet and ball strikes during play. Installation abuse can be substantial when the playing surface is hard ground; the thicker the wicket stanchion, the larger the force required to embed the wicket in the ground. If incorporated into wicket stanchions, light sticks, by virtue of their diameter, dictate a significant stanchion diameter. This, in combination with the suggested utilization of plastics for wicket construction could eventuate in wicket installation damage. Alternative embodiments propose a complex dual-thickness stanchion presenting a thinner section impaled in the ground to minimize installation loads; but this implies a more costly wicket. On the other hand, the device claimed in my patent simply attaches to a preinstalled wicket, thus eliminating installation abuse. Furthermore, my device design provides high tolerance to impacts anticipated in the croquet play environment.

It is likely because of these drawbacks that products based on the claims of U.S. Pat. No. 5,370,390 are not being marketed.

In conclusion, as far as I am aware, until the submission of my utility patent application, UNIVERSAL CROQUET WICKET LIGHTING UNIT, no solution has existed that successfully addresses all of the needs for illuminating croquet wickets for play under conditions of low lighting.

BRIEF SUMMARY OF THE INVENTION

My invention was conceived to meet the unfulfilled needs of playing the game of croquet under low illumination by combining facets of modern materials and technology. The device is not an element of a conventional croquet set. It neither replaces nor makes obsolete any part of an existing croquet set. In the preferred embodiments, a single light emitting diode provides the required illumination. In addition to high luminosity, diodes provide a long service lifetime, superb impact resistance, and efficient light emission resulting in low operating cost. The unit's components are mounted on a solid light-transmissible mounting plate, such as acrylic, with a high light index-of-refraction.

The light emitting diode is chosen with optical attributes characterized by high intensity and an appropriate cone of light emission. The diode is positioned within a hole extending through the mounting plate. The hole surface is optically diffuse and has a carefully chosen diameter, both of which combine with the diode to provide many advantages. First, this allows the diode to internally illuminate the mounting plate, providing a light image of the horizontal extension of the wicket. This clearly reveals the wicket's orientation at a distance. Second, the light emitting diode creates a strong external glow in the hole centralized in the mounting plate providing a convenient aim point for long distance shots. Third, the diode's central cone of radiation shines unattenuated through the hole creating a spotlight of intense illumination directly between the two wicket stanchions. Fourth, by capitalizing on the diode's light reflection against the hole geometry, a second cone of more diffuse light is cast outside the focused inner cone to provide broader illumination coverage around the wicket. As an added benefit, when attached to wickets distributed around a yard, these devices, under full red illumination, clearly point out their locations so as to avoid a tripping hazard.

The unit can be conveniently attached to wickets already in place on the croquet course by means of double sided hook-and-loop retaining straps, such as Velcro. The mounting plate assembly is conveniently attached to the top of the wicket, firmly hanging in position and secured against moving by means of integrated compressible friction pads. The attachment scheme is compatible with all styles of wicket by means of the universal engaging slots.

BRIEF DESCRIPTION OF THE SEVERAL VIEWS OF THE DRAWING

The drawings correspond to preferred embodiments of the invention characterized by the source of illumination being a single light emitting diode radiating 8000 millicandelas of total luminosity predominately in the red spectrum with a 30 degree cone of light focus. The diode radiates through a single 0.44 inch diameter hole in the middle of the mounting plate, with power provided by two conventional AA batteries. There are two retaining straps made of double sided hook-and-loop fasteners, such as Velcro, with hooks on one side and loops on the other, and two compressible rubber friction pads.

Note that the figures do not all relate to the same embodiment of the invention. Consult each figure description below for the related embodiment to which it applies.

REFERENCE NUMERALS

Figure 1:
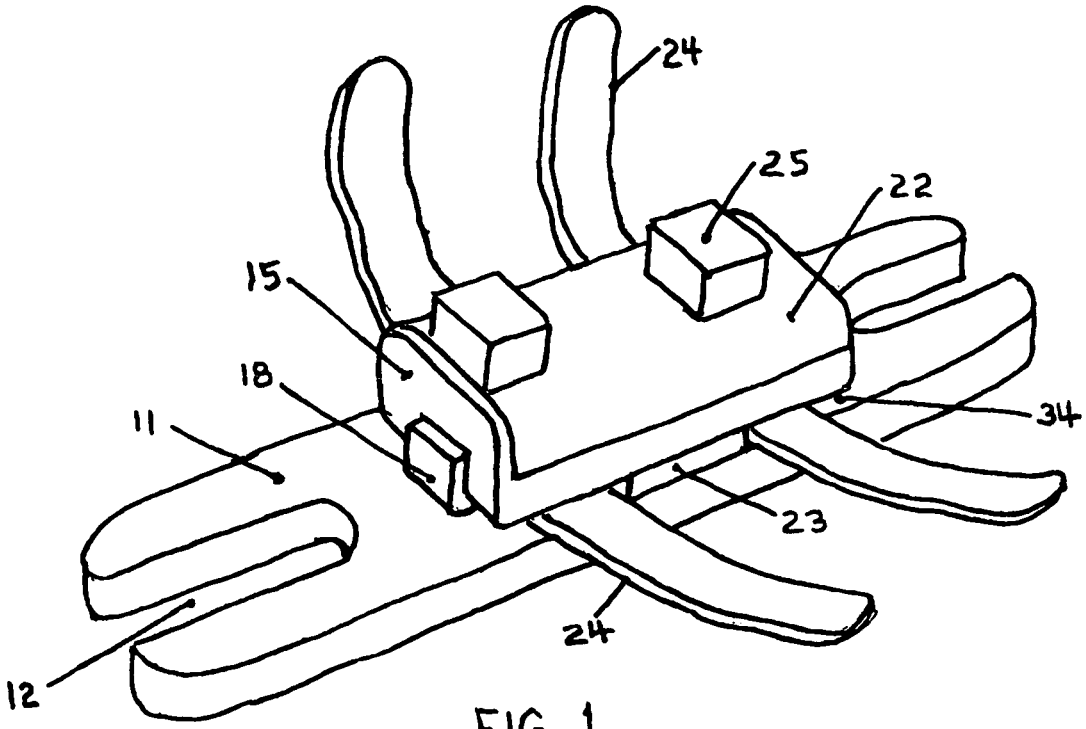
FIG. 1 is a perspective view of the topside for a first preferred embodiment of a universal croquet wicket light unit constructed in accordance with the claims of this invention.

11 mounting plate
12 universal engaging slot
13 light hole
14 light emitting diode
15 battery holder
16 resistor
17 switch knob
18 slide actuator
19 hole leg
20 solid leg
21 switch hole
22 battery cover
23 standoff spacer
24 retaining strap
25 friction pad
26 wicket stanchion
27 wicket top cross member
28 focused inner cone of illumination
29 diffuse outer cone of illumination
30 illumination radiating into mounting bar
31 variation of a yard croquet type wicket
32 official croquet association type wicket
33 playing surface
34 separation space
35 power source leads
36 component channel

DETAILED DESCRIPTION OF THE INVENTION

Filing Date Priority is Hereby claimed Based on Provisional Patent Application No. 60/431,336.

A First Embodiment

Figure 2:
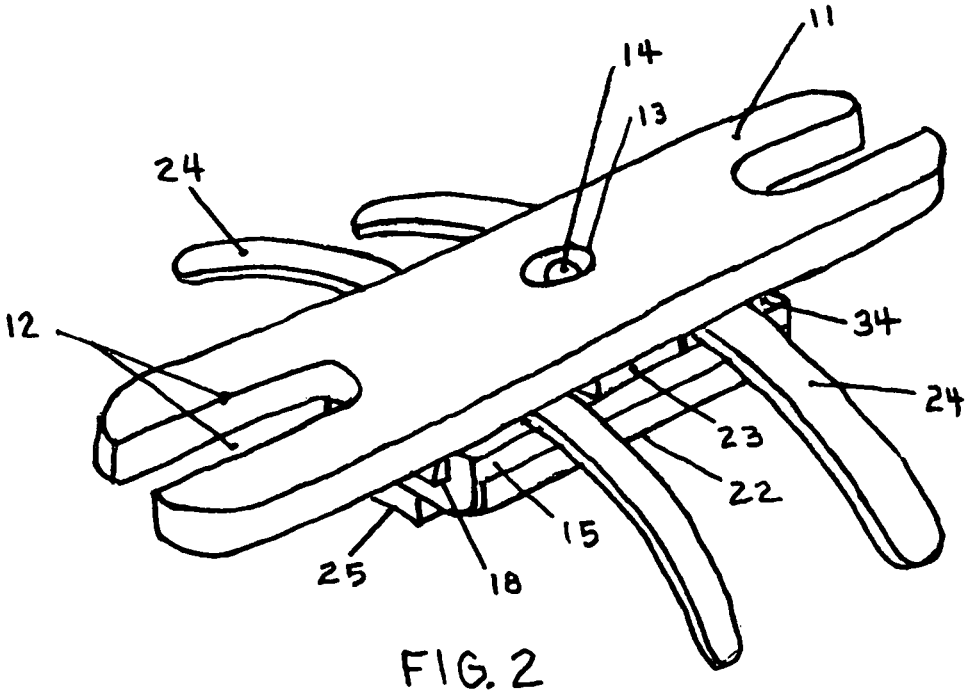
FIG. 2 is a perspective view of the underside for a first preferred embodiment of a universal croquet wicket light unit.
Figure 3:
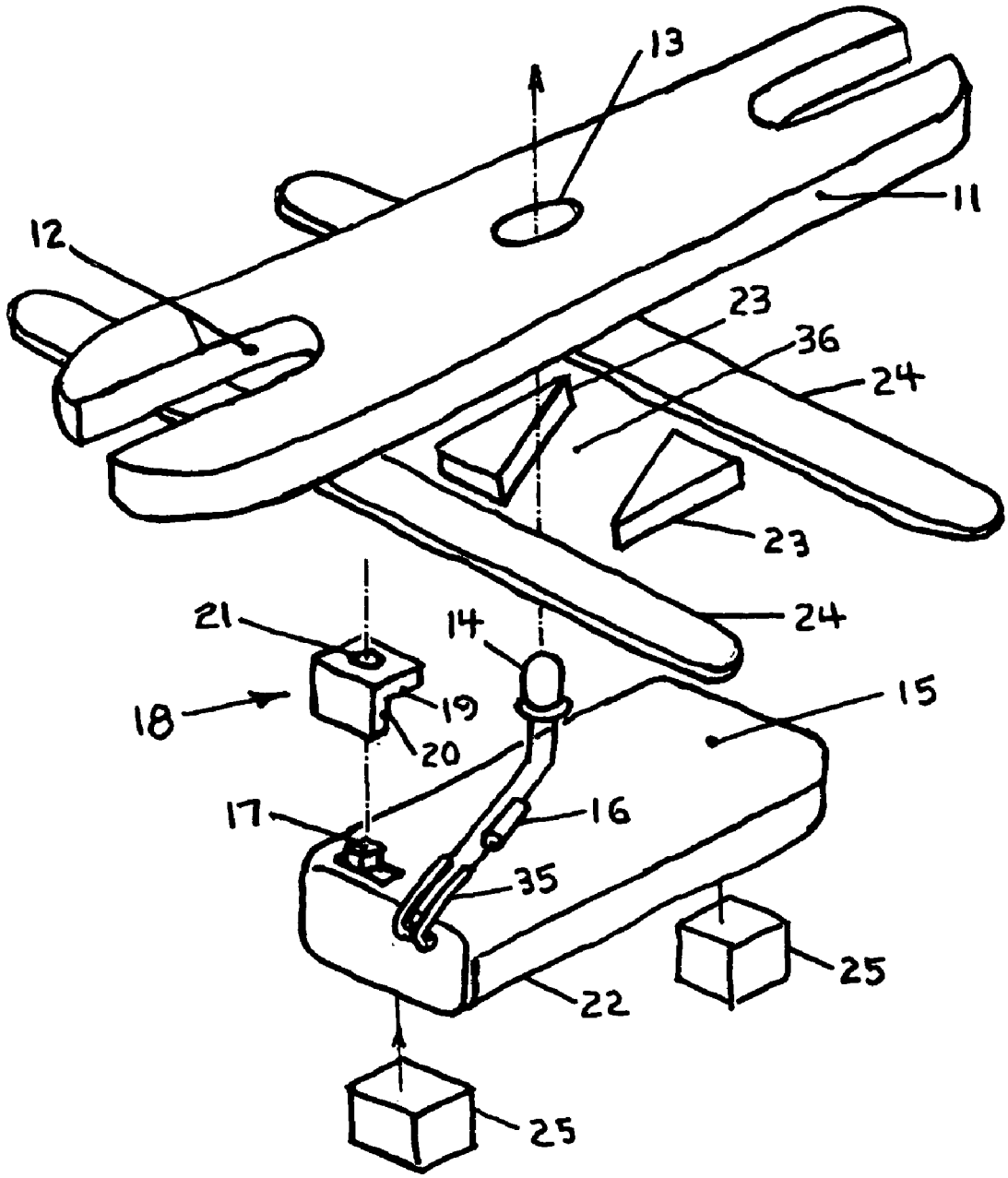
FIG. 3 is an exploded perspective view of the components of a first preferred embodiment of a universal croquet wicket light.

FIG. 1 and FIG. 2 are perspective views of a first preferred embodiment of a universal croquet wicket light unit constructed in accordance with the claims of my invention. This presents an overview of how components are arranged on the mounting plate to form the unit. In particular, this shows how: battery power 15 is provided and switched on and off 18; how the light emitting diode 14 is positioned; how the retaining straps 24 and friction pads 25 are configured and positioned relative to one another and the overall unit; and, the relationship of these components to the mounting plate 11. The circuit providing power to the light emitting diode consists of the diode, the batteries, the switch, and a current limiting resistor. How these components are typically positioned is shown as an exploded perspective view in FIG. 3.

Figure 4:
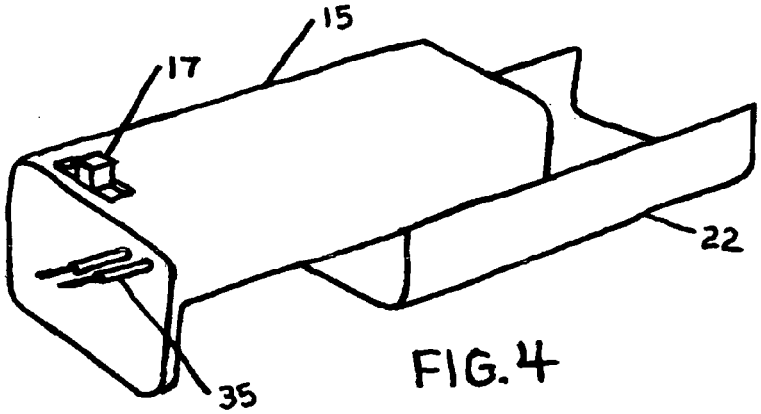
FIG. 4 is a perspective view of the battery holder showing the relationship of the integrated switch knob to the sliding battery cover for the first and third preferred embodiments of a universal croquet wicket light.
Figure 5:
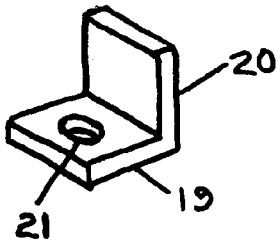
FIG. 5 is a perspective view of the slide actuator showing the switch hole for the first and third preferred embodiments of a universal croquet wicket light.
Figure 6:
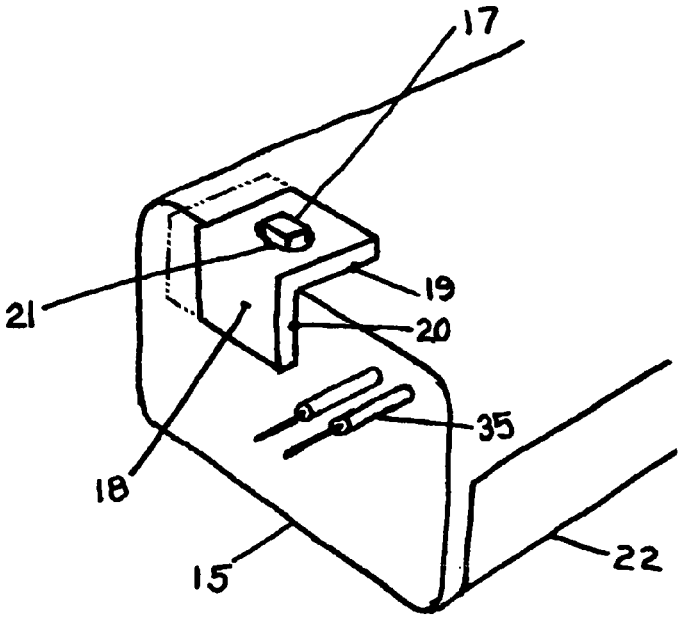
FIG. 6 is a detailed view showing how the slide actuator is juxtaposed against the battery holder and its switch knob for the first and third preferred embodiments of a universal croquet wicket light.
Figure 7:
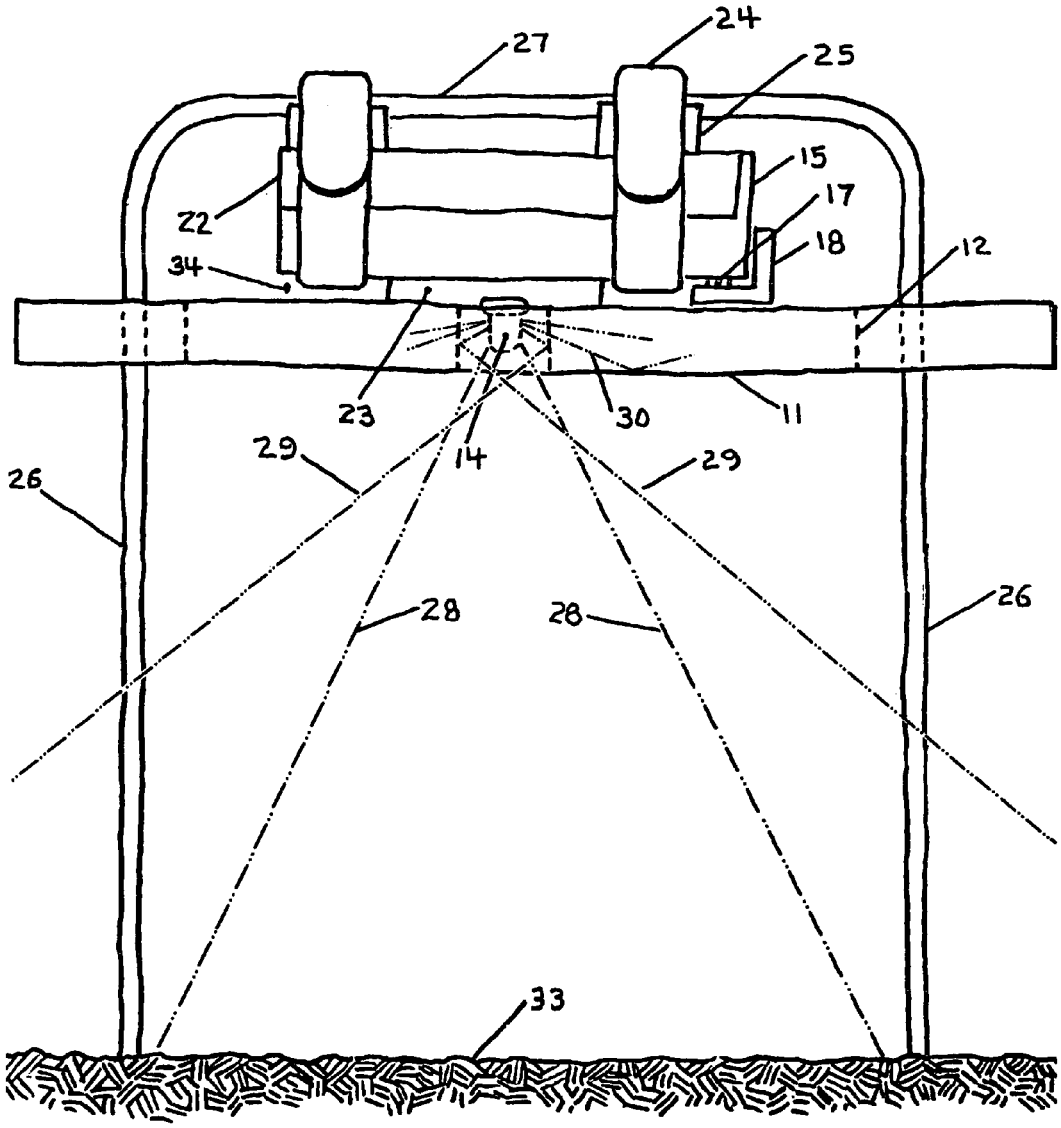
FIG. 7 is a side view, using the first embodiment, to depict: the general relationship of the universal croquet wicket light to a wicket; the light emitting diode's relationship to the mounting plate showing the internal light path and light paths for the focused and diffuse cones of illumination cast on playing surface; and, the universal attachment scheme geometry for all embodiments of a universal croquet wicket light unit.

A battery holder 15, comprising of an internally integrated switch, a switch knob 17 that presents itself externally to the battery holder, and a battery cover 22, is a commonly available electronics component. The less expensive of these type battery holder units usually locate the switch knob relative to the overall geometry of the battery holder as shown in FIG. 4. In mounting this type battery holder to the mounting plate, the battery cover must be accessible for the user to change batteries when necessary. This requires that the battery cover face away from the mounting plate. Such orientation unavoidably renders the switch knob inaccessible to a user's direct actuation, in effect, hiding the switch knob between the battery holder and component mounting plate. While there are many conceivable mechanisms to gain access to this hidden switch knob, it is evident that the best design would be one that is (a) simple (b) inexpensive (c) easy to manufacture (d) protected from impact damage, and (e) reliable; all of these are met in this first preferred embodiment. This is done by juxtaposing the two legs of an "L" shaped slide actuator 18 against adjacent sides of the end of the battery holder. This interposes a leg 19 between the battery holder and mounting plate to engage the switch knob hidden therein, while the other leg 20 remains physically accessible for user switch actuation. The switch hole 21 in the hole leg of the "L" thus engages the switch knob, and a user can then slide the exposed solid leg to actuate the hidden switch knob. FIG. 5 is an overview showing how the slide actuator is positioned relative to the battery holder and its switch knob. The switch hole in the hole leg of the slide actuator has a diameter that will closely fit over the switch knob. The standoff spacer 23 ensures sufficient separation between the battery holder and mounting plate to allow free motion of the switch knob. The thickness of the hole leg of the slide actuator is then chosen so as to slidably fit in the space between the battery holder and the mounting plate. During fabrication, the standoff spacer and hole leg of the slide actuator are sandwiched between the battery holder and mounting plate, the switch hole fitting over and engaging the switch knob. The switch knob, in turn, slidably constrains the slide actuator between the battery holder and mounting plate, allowing only sliding motion of the slide actuator between on/off positions. FIG. 7 shows an edge view of the relationship of the slide actuator to the battery holder, the standoff spacers, and the mounting plate. My invention's design shields all parts of the slide actuator from direct contact with balls or mallets, thus making the switching mechanism tolerant to such impacts.

The electric circuit, that provides power from the batteries to the light emitting diode, connects the internally switched positive and negative power source leads 35 through a current limiting resistor to the two leads of the light emitting diode. The electrical continuity of this circuit is controlled by a switch that is integrated within the battery holder. The circuit is protected against indirect physical impact by immobilizing components. The circuit is protected against direct impact from every angle by virtue of it's position within the component channel 36 created by the two standoff spacers.

FIG. 7 illustrates the light emitting diode's relationship to the mounting plate. This shows how the diode (a) internally illuminates the mounting plate (b) focuses a strong spot of light directly beneath the wicket, and (c) provides a second broader cone of diffuse illumination. One novel aspect of my invention involves the orchestration of a number of illumination phenomena to satisfy certain needs for playing night croquet. The needs are to (a) strongly illuminate an area directly under a wicket to visually confirm passage of a ball (b) delineate the orientation of the wicket from a distance (c) present a convenient central visual aiming target for precision shots to the wicket, and (d) provide some illumination to facilitate play in the wicket's broader vicinity. Key to meeting these needs is the choice of a light emitting diode as the illumination source. Diode's are available with a wide selection of properties, so proper selection is critical to meeting these design needs. The proper choice of diode will have a narrow cone of focus. To provide optimal direct lighting beneath the wicket, the diode's cone of focus must be allowed to shine directly on the playing surface. This is accomplished via a light hole 13 in the mounting plate. When the diameter of this hole is properly chosen, the diode will also reflectively interact with the walls of the hole to create a secondary broader circular area of illumination beneath the wicket. If the mounting plate is light-transmissible material with an index of refraction great enough to capture internal illumination, and if the edges of the mounting plate have a light diffusing surface texture, then the edges of the mounting plate become vividly illuminated to delineate the wicket's orientation. Furthermore, if the light hole has an optically diffuse surface, then the diode will illuminate the hole's surface area, and it becomes visible as a concentrated central target of light that can serve as an aim point for the player.

Figure 8:
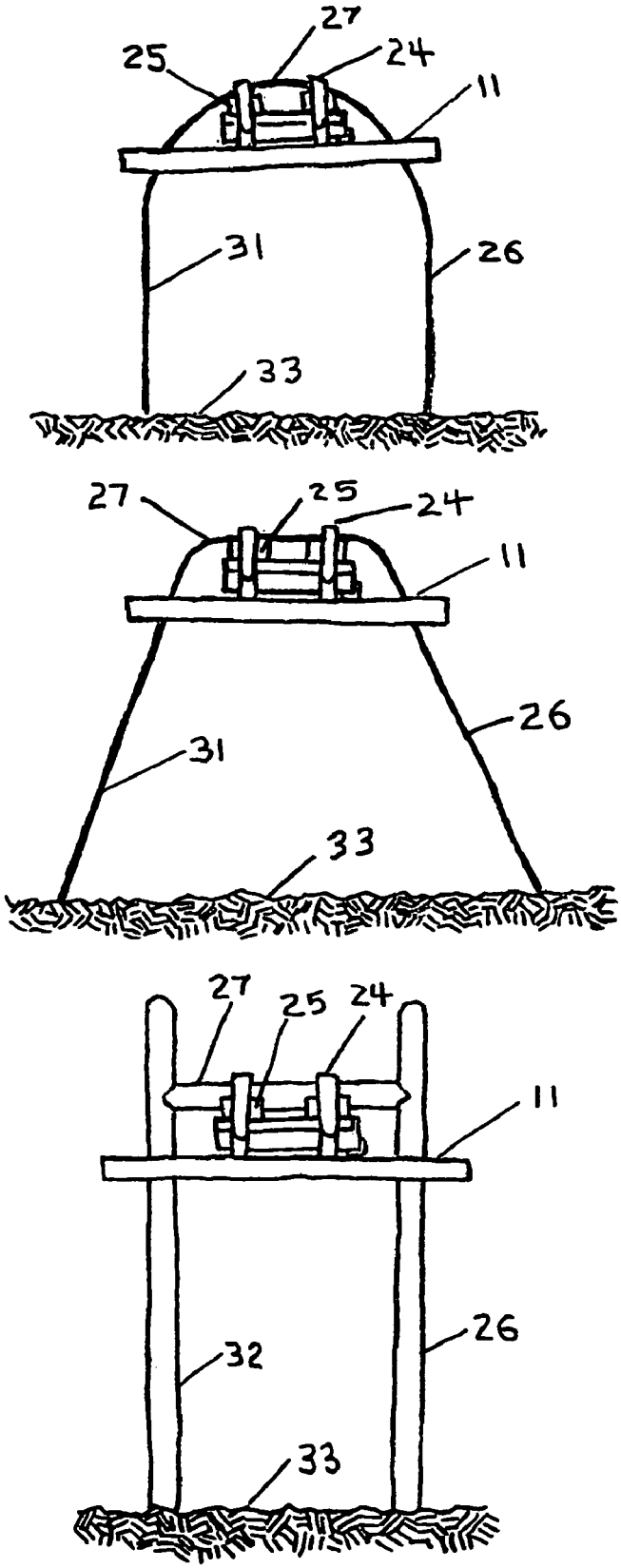
FIG. 8 depicts how the croquet wicket light unit's universal attachment scheme would apply to different style wickets for all embodiments of a universal croquet wicket light.

FIG. 7 shows a detailed view of the means of attaching a universal croquet wicket light unit to a wicket. This illustrates how the double-sided hook-and-loop retaining straps 24 hold the top cross member of the wicket firmly against the friction pads 25. A problem arises in attempting to secure a lighting unit to the top of a wicket because of the small diameter of the wire from which wickets are commonly made. This makes it almost impossible to join the ends of a hook-and-loop retaining strap around a wicket while still maintaining effective tension in the strap. My invention uses friction pads of compressible rubber to provide a high friction anti-slide surface to bear against the wicket. Friction pad compressibility is used to provide a convenient mechanism for closing the retaining straps around the wicket wire while easily maintaining strap tension to firmly hold the friction pad against the wicket. One novel feature, allowing attachment of the croquet wicket light unit to all known wicket types, is the universal engaging slot 12. This slot, in effect, allows the wicket and the mounting plate to mutually and securely straddle and engage one another. By proper choice of slot depth and width, all the varied sizes of wickets can be accommodated. FIG. 8 depicts how the universal attachment scheme would apply to different style wickets.

A Second Embodiment

A second preferred embodiment of the wicket light unit is different from the first embodiment, only due to a slight difference in the battery holder unit incorporated in the embodiments. This difference is characterized by the location for the switch knob on the battery holder. In the first embodiment, the switch knob 17 was located on the side opposite to the battery cover 22. It is possible to utilize a battery holder with the switch knob located either on the same side as, or on a side adjacent to, the battery cover. This eliminates the slide actuator 18 mechanism described in the first embodiment since a user would have direct access for actuating a switch knob so located. Battery holders such as described in this second embodiment are usually less compact, and more expensive to manufacture; this is why the first and third embodiments do not incorporate this style of battery holder, even though an additional switch actuation mechanism is required. All other aspects of the universal croquet wicket lighting unit are identical between the first and second embodiments.

A Third Embodiment

Figure 9:
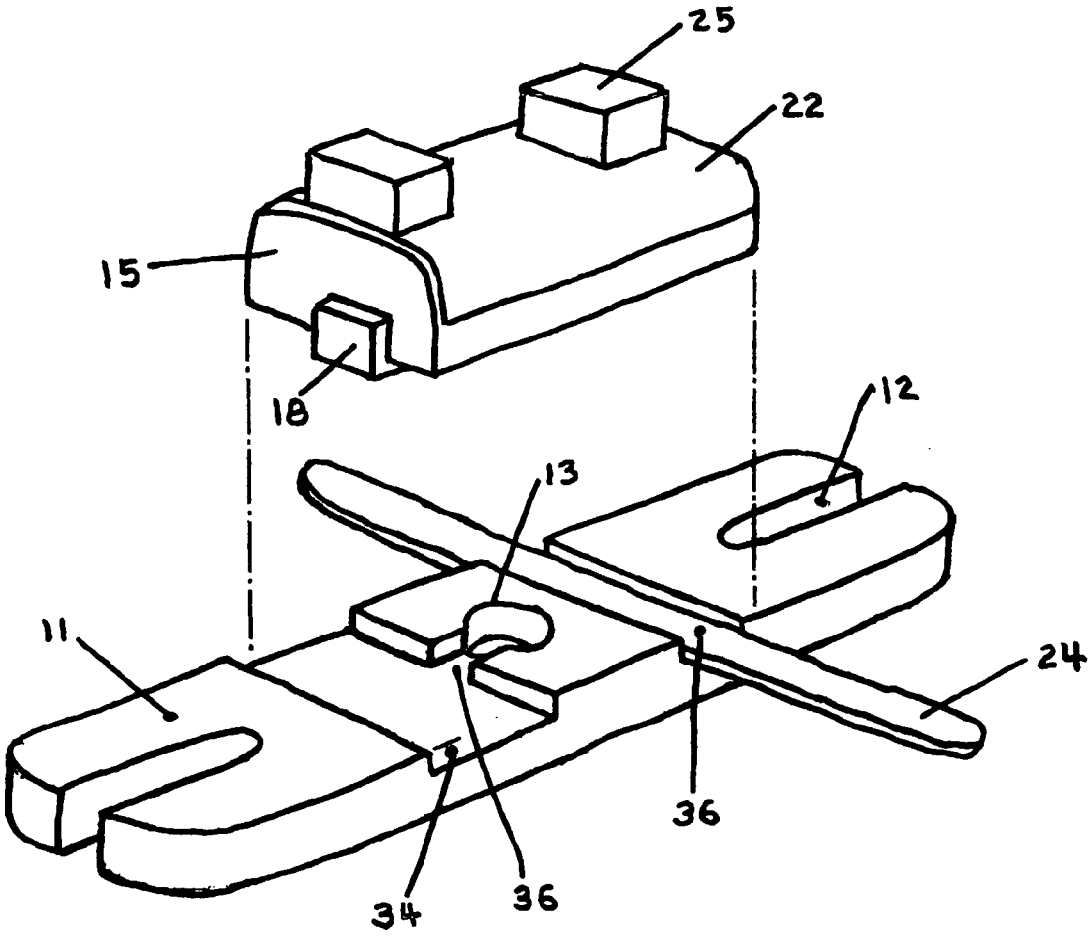
FIG. 9 depicts the separation spaces and component channels associated exclusively with the third embodiment of a universal croquet wicket light.

FIG. 9 illustrates aspects of a third preferred embodiment of the wicket light unit. This embodiment is different from the first embodiment, only in that the separation space between the battery holder and the mounting plate, needed for mounting components, is provided in a different fashion than in the first embodiment. In this third embodiment, separation space and component channels are created as recesses in the mounting plate. In the first embodiment, standoff spacers are employed exclusively to create the separation space and component channels.

Whereas the invention has been shown and described in connection with preferred embodiments thereof, it will be understood that many modifications, substitutions and additions may be made that are within the intended broad scope of the claims. There has therefore been shown and described three such embodiments based on the claims in my patent, and which accomplishes all the stated objectives pertaining to playing the game of croquet under low illumination conditions.

Operation of Invention

The universal wicket light unit is conveniently attached to a preexisting wicket after the wicket has been embedded in the ground. This is done by placing the mounting plate inside the wicket arch so that both stanchions of the inverted "U" shaped wicket passes through the corresponding universal engaging slots in the mounting plate. In effect, wicket and mounting plate mutually straddle one another. Next the unit is firmly pressed up into place, compressing the friction pads against the top cross member of the wicket. Finally, the hook-and-loop retaining straps are fastened over the top of the wicket. The universal croquet wicket light unit now hangs from the wicket with the light hole oriented down to illuminate the ground directly beneath the wicket. The friction pads, by virtue of their compressibility, maintain the hook-and-loop retaining straps in a state of tension, holding the friction pads firmly against the wicket. Minor adjustments can be made to the device's position to direct the light beam exactly between the two wicket stanchions. The combination of the universal engaging slots in the mounting plate and the friction pads on top of the battery holder, in conjunction with the hook-and-loop retaining straps provide secure and reliable positioning of the universal croquet wicket light on all type of wickets.

The wicket light is turned on by moving the slide actuator that is slidably constrained between the battery holder and the mounting plate. The resulting light provides an intense spot of illumination directly beneath the wicket that clearly reveals a ball passing through the wicket. In addition, there is provided a second level of less intense lighting over a larger area around the wicket for illumination of balls in the general proximity. The edges of the illuminated mounting plate clearly reveal the orientation of the wicket. Also visible in the mounting plate is an intense central spot of illumination that serves as an aim target for long distance shots at the wicket. In addition to these practical illumination functions of the wicket lighting units, they also present a pleasing appearance on the wicket course.

What I claim as my invention is:

1. A method for illuminating the playing surface in the vicinity of a preexisting and preinstalled croquet wicket for playing the game of croquet under conditions of low ambient illumination by means of an electric lighting unit that can be universally attached to all existing types of croquet wickets, and comprising methods for:

(a) aggregating and mounting related electrical and mechanical components on a mounting plate in such a way as to compactly form an integrated unit that can be conveniently attached to said wicket;

(b) supplying power from batteries to one or a plurality of electric light emitters;

(c) switching on and off said power;

(d) positioning said electric light emitters within said mounting plate so as to directly illuminate the croquet playing surface around said wicket;

(e) providing both a focused and a diffuse cone of illumination beneath said wicket;

(f) attaching said unit to said wicket in a universal fashion, such that all conventional said wickets used in croquet are accommodated; and (g) preventing said unit, attached to said wicket, from slipping with respect to said wicket;

all, whereby playing the game of croquet can be facilitated under conditions of low illumination by attaching said wicket electric lighting unit to a preexisting conventional croquet wicket already positioned and installed on the croquet playing course.

* * * * *